US010077578B2

(12) United States Patent
Alfredsson

(10) Patent No.: US 10,077,578 B2
(45) Date of Patent: Sep. 18, 2018

(54) LOCK FOR LEFT OR RIGHT HAND OPERATION

(71) Applicant: Industrilås i Nässjö Aktiebolag, Nässjö (SE)

(72) Inventor: Bengt-Åke Alfredsson, Bodafors (SE)

(73) Assignee: Industrilås i Nässjö Aktiebolag, Nässjö (SE)

( * ) Notice: Subject to any disclaimer, the term of this patent is extended or adjusted under 35 U.S.C. 154(b) by 168 days.

(21) Appl. No.: 15/310,409

(22) PCT Filed: May 11, 2015

(86) PCT No.: PCT/EP2015/060335
§ 371 (c)(1),
(2) Date: Nov. 10, 2016

(87) PCT Pub. No.: WO2015/173176
PCT Pub. Date: Nov. 19, 2015

(65) Prior Publication Data

US 2017/0268259 A1 Sep. 21, 2017

(51) Int. Cl.
*E05B 63/04* (2006.01)
*E05B 61/00* (2006.01)

(52) U.S. Cl.
CPC ..... *E05B 63/04* (2013.01); *E05B 61/00* (2013.01)

(58) Field of Classification Search
CPC . E05B 9/08; E05B 63/04; E05B 61/00; E05C 19/02

(Continued)

(56) References Cited

U.S. PATENT DOCUMENTS 3,141,319 A * 7/1964 Schlage ..... E05B 63/0017 70/134
3,589,152 A * 6/1971 Glass ..... E05B 63/0017 292/140

(Continued)

FOREIGN PATENT DOCUMENTS

DE 202012008683 U1 10/2012
FR 2629506 A1 10/1989

(Continued)

OTHER PUBLICATIONS

International Search Report and Written Opinion for International Application No. PCT/EP2015/060335, dated Jul. 16, 2015 (10 pages).

*Primary Examiner* — Suzanne L Barrett
(74) *Attorney, Agent, or Firm* — Kagan Binder, PLLC

(57) ABSTRACT

The present disclosure relates to a lock (1) for a door comprising a housing (10) having a circular opening (11) in which a radial protrusion (12) is arranged, and a guide ring (20) arranged in the opening. The guide ring comprises a left locking means (22, 24) and a right locking means (22, 26). The radial protrusion is in a first position of the guide ring located between the left locking means and the right locking means on the guide ring. The guide ring is configured to be rotatable from the first position in a first direction (L) into a left locking position such that the protrusion engages with the left locking means so as to lock the guide ring relative to the housing, and configured to be rotatable from the first position in a second direction (R), opposite the first direction, into a right locking position such that the protrusion engages with the right locking means so as to lock the guide ring relative to the housing. A lock which after arrangement to a door may be configured for left or right hand operation is thereby provided.

14 Claims, 7 Drawing Sheets

(58) Field of Classification Search
USPC ..... 70/370, 371, 379 R, 462
See application file for complete search history.

(56) References Cited

U.S. PATENT DOCUMENTS

| | | | | |
|---|---|---|---|---|
| 4,099,397 | A | 7/1978 | Dauenbaugh | |
| 4,403,485 | A * | 9/1983 | Scherbing | A44B 19/301 70/379 R |
| 5,435,159 | A * | 7/1995 | Ramsauer | E05B 9/084 70/370 |
| 5,737,950 | A * | 4/1998 | Yun-Bin | E05B 17/04 70/374 |
| 6,067,827 | A | 5/2000 | Haseley et al. | |
| 7,874,189 | B2 * | 1/2011 | Martin | E05B 9/084 70/107 |
| 8,621,901 | B2 * | 1/2014 | Bacon | E05B 9/086 70/337 |
| 2008/0060401 | A1 * | 3/2008 | Ramsauer | E05B 1/0092 70/370 |
| 2017/0101805 | A1 * | 4/2017 | Mitchell | E05B 3/065 |

FOREIGN PATENT DOCUMENTS

| | | | |
|---|---|---|---|
| GB | 636382 | A | 4/1950 |
| GB | 2275734 | A | 9/1994 |

* cited by examiner

LOCK FOR LEFT OR RIGHT HAND OPERATION

CROSS-REFERENCE TO RELATED APPLICATIONS

This application claims priority to International Application No. PCT/EP2015/060335, filed May 11, 2015, and titled "LOCK FOR LEFT OR RIGHT HAND OPERATION", which in turn claims priority from European Application having serial number 14167819.3, filed on May 12, 2014, both of which are incorporated herein by reference in their entireties.

TECHNICAL FIELD

The present disclosure relates to a lock, and especially a lock for arrangement on a door.

BACKGROUND

Door assemblies in for instance ventilation arrangements may comprise a lock on the door. The lock comprises a lock arm constituted by a roller cam, a bolt or the like, that is rotatable from an open position, wherein the lock arm preferably extends in a vertical direction, to a closed position. In the closed position the lock arm extends in a horizontal direction, or a direction substantially transverse the direction of the open position, to engage with a door frame in order to lock the door. The lock is rotatable about 90 degrees from the open position to the closed position.

Such lock is used as a cost-effective way of providing a closing function of a door. However, there is a difference in how such lock is operated depending on how the door is suspended. If the door is suspended on hinges on a right side, to be opened at the left side, the lock should be configured to rotate counterclockwise when moved from the open position to the closed position. If the door conversely is suspended at the left side, the lock should be configured to rotate clockwise when moved from the open position to the closed position.

Hence, in order not to force a user who assembles the lock on a door to arrange the lock upside down in one of the applications, two differently configured locks needs to be provided for the two different applications. The parts in the two configurations may be the same or similar. However, they need to be assembled differently to provide each configuration of the lock. The manufacturer of the locks thereby needs to offer two versions of the lock. A user of the locks, who assembles the locks to doors further needs to have both lock configurations at hand to be able to assemble locks on both left and right hand opened doors. This increases costs for manufacturing the locks as well as stock management for the user.

Consequently, there is a need for a way of providing locks for both left and right hand opened doors with reduced cost.

SUMMARY

It is an object of the present invention to provide an improved solution that alleviates the mentioned drawbacks with present devices. Furthermore, it is an object to provide a lock that in the same configuration may function as a left hand operated or a right hand operated lock.

According to a first aspect of the invention, this is provided by a lock for a door comprising a housing having a circular opening in which a radial protrusion is arranged, and a guide ring arranged in the opening. The guide ring comprises a left locking means and a right locking means. The radial protrusion is in a first position of the guide ring located between the left locking means and the right locking means on the guide ring. The guide ring is configured to be rotatable from the first position in a first direction into a left locking position such that the protrusion engages with the left locking means so as to lock the guide ring relative to the housing, and configured to be rotatable from the first position in a second direction, opposite the first direction, into a right locking position such that the protrusion engages with the right locking means so as to lock the guide ring relative to the housing.

The lock may thereby be assembled into an intermediate configuration, wherein the guide ring is in the first position, wherein it is not decided whether the lock is left hand operated or right hand operated. A manufacturer of the locks may thereby provide only locks in the intermediate configuration. A user may only need to store locks in this configuration. After the lock has been assembled to a door it may be decided if the lock becomes configured for left or right hand operation. If the guide ring then is rotated in the first direction, the guide ring may become locked in the left locking position and the lock may become left hand operated. If the guide ring instead is rotated in the second direction, the guide ring may become locked in the right locking position and the lock may become right hand operated. The left locking means and the right locking means may respectively enable rotation of the guide ring to one of the locking positions, and prevent the guide ring from rotation back from a locking position to the first position. The first rotation of the guide ring relative to the housing a radial protrusion, from the first position, may decide whether the lock becomes configured for left or right hand operation. After such first rotation, the guide ring may be prevented from being rotated back to the first position, or to the other locking position. The lock may further comprise means for holding the guide ring axially in place relative to the housing. Such means may be of resilient material or it may be a spring. Such means may bias the guide ring towards the radial protrusion. Such means may further prevent the guide ring from unintentionally being moved from the first position or any of the locking positions.

In one embodiment, the left and right locking means may be arranged on an axial rim of the guide ring. The radial protrusion in the opening of the housing may extend to abut the axial rim of the guide ring. The left and right locking means may be arranged on the axial rim such that rotation of the guide ring provides the radial protrusion to engage with the left or the right locking means. The guide ring may be arranged coaxial with the opening in the housing. The axial rim of the guide ring may thereby face into the opening and towards the radial protrusion.

In another embodiment, each of the left and right locking means may comprise an inclined member engageable with the radial protrusion. The inclined member may provide a locking function of each of the locking means. The radial protrusion may engage with the inclined member such that the guide ring may be rotated such that the protrusion moves relative the inclined member towards the locking position. When the protrusion has reached the locking position, the inclined member may prevent the protrusion from moving back relative the inclined member, i.e. prevent the guide ring from moving back towards the first position. In a further embodiment, each inclined member may comprise two inclined parts forming a locking groove in between. The radial protrusion may engage with the inclined parts and be locked in the locking groove when the guide ring is in one of the locking positions.

In one embodiment, when the guide ring is in the left locking position, the lock may be left-hand operated when arranged on a door, and when the guide ring is in the right locking position, the lock may be right-hand operated when arranged on a door. The position of the guide ring may decide the configuration of the lock. When the guide ring is in the first, intermediate, position, the configuration of the lock is not decided. The configuration is not decided until the guide ring is rotated into one of the locking positions.

In a further embodiment, the lock may further comprise a lock cylinder. The lock cylinder may be arranged in the opening and configured to rotate the guide ring. The lock cylinder may extend through the opening to engage with the guide ring such that rotation of the lock cylinder provides rotation of the guide ring. The lock cylinder may provide an external access to the rotation of the guide ring in the housing. The lock cylinder may be provided with a keyhole to provide rotation of the lock cylinder, and the guide ring, by a key. When the lock cylinder is rotated, its engagement with the guide ring may provide a rotation of the guide ring to one of the lock positions. After the guide ring has been locked in a locking position relative to the housing, the lock cylinder may be rotated for opening or closing the lock, i.e. opening and closing a door on which the lock may be assembled.

In one embodiment, the guide ring may comprise an inner peripheral recess. In a further embodiment, the lock cylinder may comprise an external protrusion on an outer surface of the lock cylinder, which external protrusion may be configured to be arranged in the peripheral recess of the guide ring. The engagement between the external protrusion and the peripheral recess may provide a transfer of rotational movement from the lock cylinder to the guide ring. The lock cylinder may be rotated to rotate the guide ring from the first position to one of the locking position by the external protrusion pushing the guide ring. The external protrusion may extend into the peripheral recess a side surface of the external protrusion may abut an end surface of the recess. The peripheral recess may extend along at least 80 degrees of an inner circumference of the guide ring, preferably between 90-150 degrees, more preferably between 110-140 degrees. The circumferential extension of the recess may set the extent of rotation of the lock cylinder. When the guide ring is in one of the locking positions, i.e. when the guide ring is locked relative to the housing, the extent of the peripheral recess may limit the rotatability of the lock cylinder relative to the housing.

When the guide ring is moved to the left locking position, the peripheral recess is moved. In one embodiment, when the lock is arranged on a door and the guide ring is in the left locking position, the peripheral recess may be arranged to enable movement of the lock cylinder for left hand operation of the lock. Similarly, when the guide ring is in the right locking position, the peripheral recess may be arranged to enable movement of the lock cylinder for right hand operation of the lock. The recess may enable a rotation of the lock cylinder of about 90 degrees. The lock cylinder may thereby be rotated from an open position to a closed position.

The lock cylinder may be coupled to a lock arm configured to engage a door frame in a closed position when the lock is arranged on a door and the lock cylinder is in a closed position. The lock arm may be moved from the closed position to an open position when the lock cylinder is rotated from the closed position to the open position. The lock arm may be moved about 90 degrees when moved from the closed position to the open position. The peripheral extension of the peripheral recess on the guide ring may limit the rotation of the lock cylinder by limiting the movement of the external protrusion on the lock cylinder.

When the guide ring is in the first position, the peripheral recess may have a position corresponding to an open position of the lock.

In one embodiment, the radial protrusion may comprise a first radial protrusion and a second radial protrusion. A further stability to the locking of the guide ring relative to the housing may thereby be provided. Further, the guide ring may comprise a first locking means, a second locking means and a third locking means, wherein when the guide ring is in the first position, the first radial protrusion may be located between the first locking means and the second locking means. The second radial protrusion may further be located between the second locking means and the third locking means. For the first radial protrusion, the second locking means may then be a left locking means and the first locking means may be a right locking means. For the second radial protrusion the third locking means may be a left locking means and the second locking means may be a right locking means. Hence, the second locking means may function as both left locking means and right locking means, for the two radial protrusions respectively.

BRIEF DESCRIPTION OF THE DRAWINGS

The invention will in the following be described in more detail with reference to the enclosed drawings, wherein.

DESCRIPTION OF EMBODIMENTS

Figure 1:
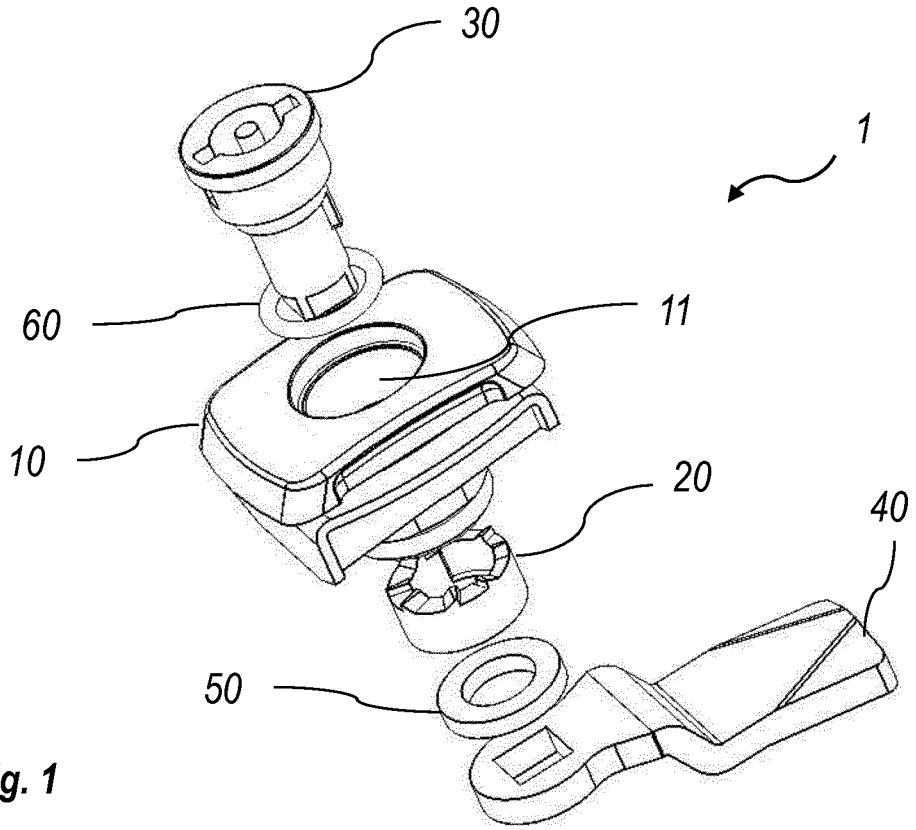
FIG. 1 shows an exploded perspective view of a lock according to an embodiment of the invention.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

Figure 2:
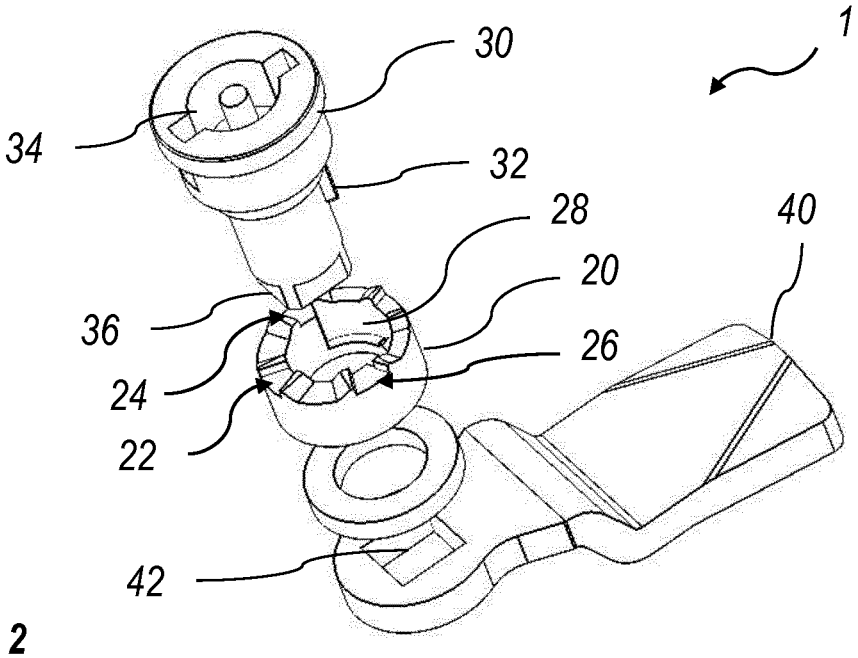
FIG. 2 shows an exploded perspective view of a lock according to an embodiment of the invention.

FIGS. 1 and 2 illustrate a lock 1 according to an embodiment of the invention. The lock 1 comprises a housing 10, a guide ring 20, a lock cylinder 30 and a lock arm 40. The guide ring 20 and the lock cylinder 30 are configured to be arranged in an opening 11 in the housing 10.

The lock arm 40 has an opening 42 configured to receive a correspondingly shaped end piece 36 of the lock cylinder 30. The opening 42 and the end piece 36 may be rectangular shaped. The lock arm 40 is thereby rotatably fixed relative to the lock cylinder 30.

The lock cylinder 30 comprises a key hole 34 for receiving a key to turn the lock cylinder 30. Such rotation of the lock cylinder 30 thereby rotates the lock arm 40.

The lock cylinder 30 further comprises, on an outer surface, an external protrusion 32. The external protrusion 32 is configured to be arranged in a peripheral recess 28 in the guide ring 20.

The lock 1 further comprises a ring 50 arranged between the guide ring 20 and the lock arm 40, and a sealing ring 60 arranged between the lock cylinder 30 and the housing 10. The ring 50 provides that the guide ring 20 is held in place in the housing 10.

Figure 3:
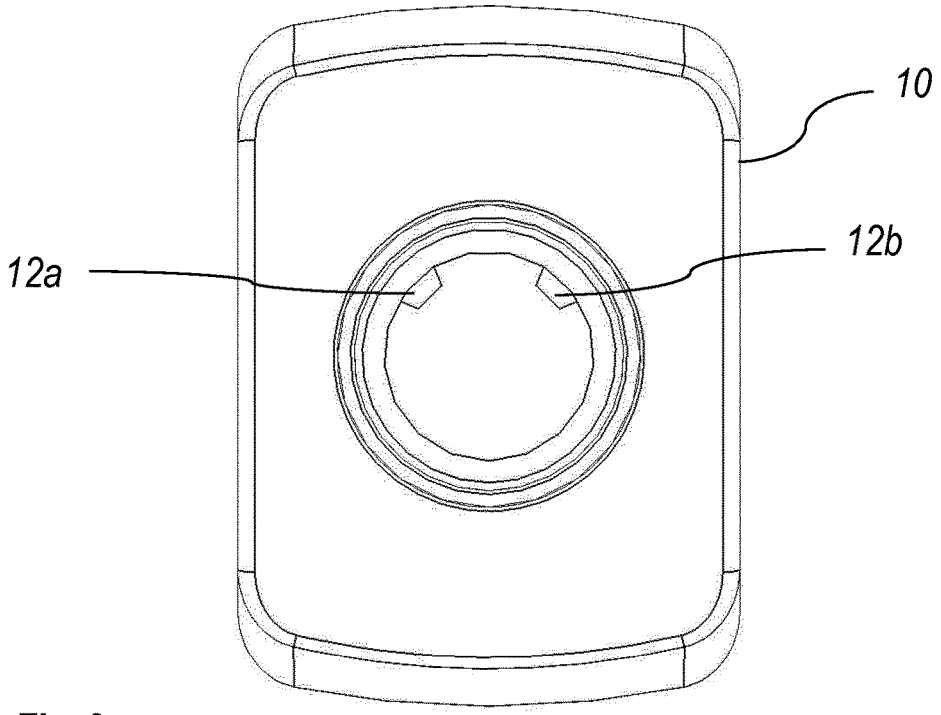
FIG. 3 shows a top view of a housing according to an embodiment of the invention.

As seen in FIG. 3, the housing 10 comprises two radial protrusions 12*a*, 12*b* arranged in the opening 11. The radial protrusions 12*a*, 12*b* are arranged with a distance to each other. The distance may be a peripheral distance of about 90 degrees. Each protrusion 12*a*, 12*b* has a tapering shape towards a radial centre of the opening 11. Even though the illustrated embodiment comprises two radial protrusions, the present invention functions similarly with one protrusion, or three or four protrusions.

Figure 4:
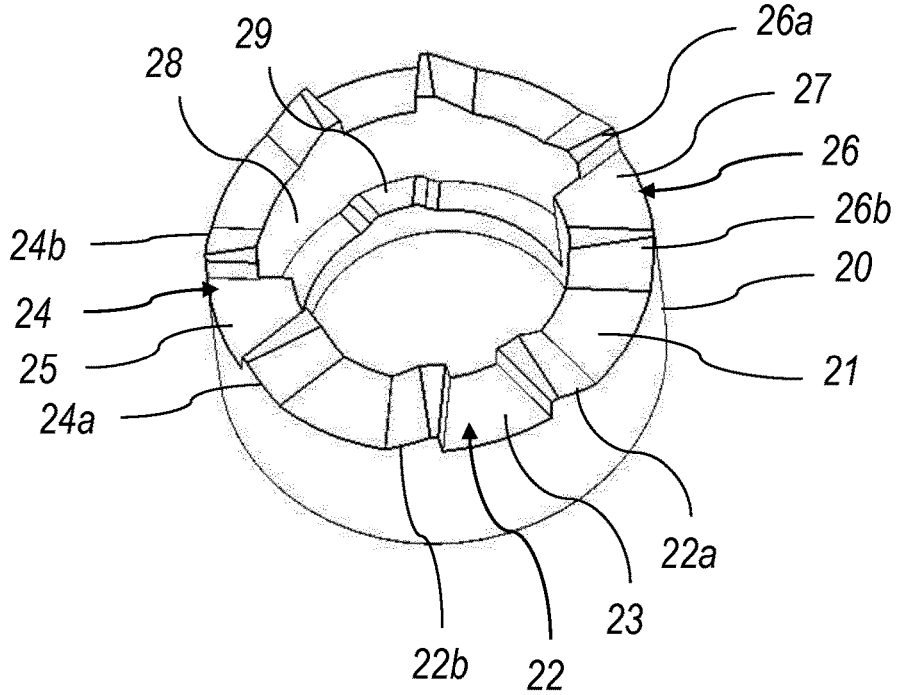
FIG. 4 shows a perspective view of a guide ring according to an embodiment of the invention.

As seen in FIG. 4, the guide ring 20 comprises an axial rim surface 21. On the axial rim surface 21, left and right locking means 22, 24, 26 are arranged. The locking means 22 comprises a first and a second locking part 22*a*, 22*b*. Between the locking parts 22*a*, 22*b* is a locking groove 23 formed. Each locking part 22*a*, 22*b* has an inclined surface extending towards the locking groove 23. Each of the locking means 24, 26 comprises similar respective locking parts 24*a*, 24*b*, 26*a*, 26*b*, and locking grooves 25, 27. Each locking groove 23, 25, 27 tapers in a direction towards a radial center of the guide ring 20. The shape of each locking groove 23, 25, 27 corresponds to the shape of the radial protrusions 12*a*, 12*b* in the opening 11 of the housing 10.

Figure 5A:
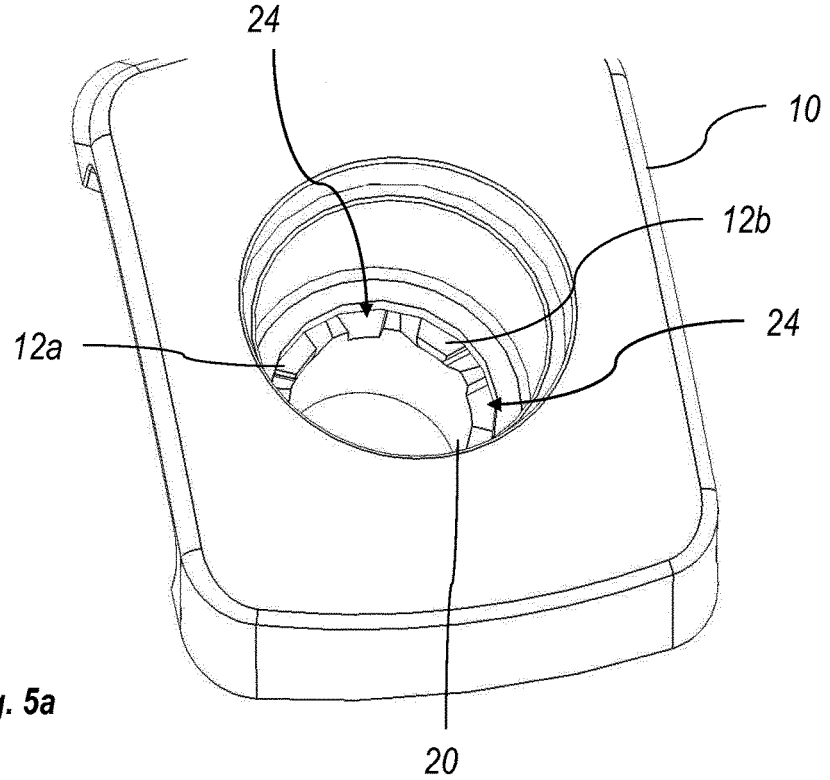
FIGS. 5*a* and 5*b* show perspective views of a housing and guide ring according to an embodiment of the invention.
Figure 5B:
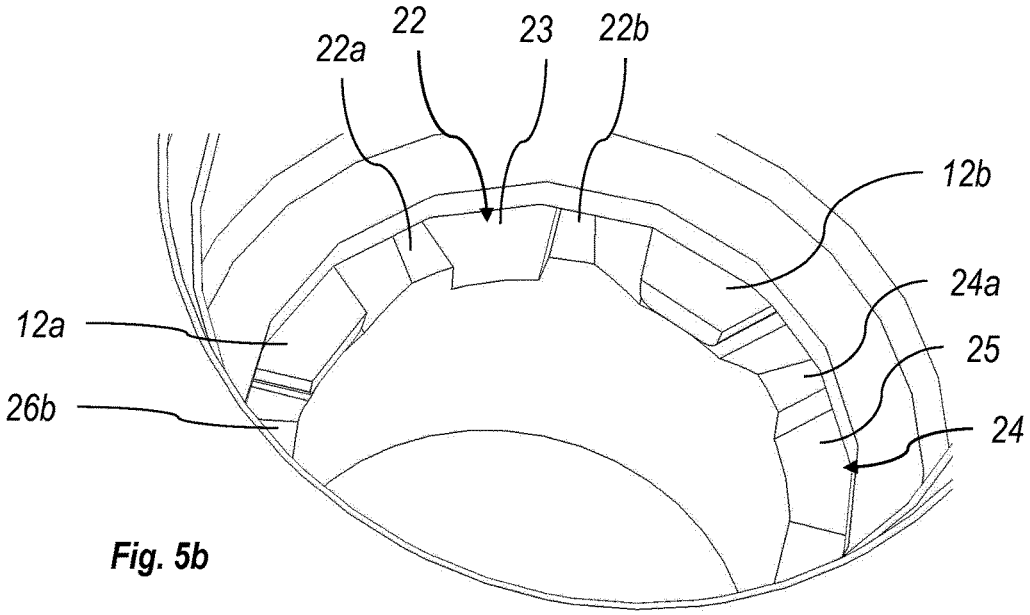

FIGS. 5*a* and 5*b* illustrates the guide ring 20 arranged in the opening 11 of the housing 10. The guide ring 20 is in a first, intermediate, position wherein the protrusions 12*a*, 12*b* are located between the locking means 22, 24, 26 on the guide ring 20. For the first protrusion 12*a* is the locking means 22 a left locking means, and locking means 26 is a right locking means. I.e. when the guide ring 20 is rotated to the left the first protrusion 12*a* will reach the left locking means 22, and when the guide ring 20 is rotated to the right the first protrusion 12*a* will reach the right locking means 26. Similarly, for the second protrusion 12*b* is the locking means 24 a left locking means, and the locking means 22 is a right locking means.

Figure 6:
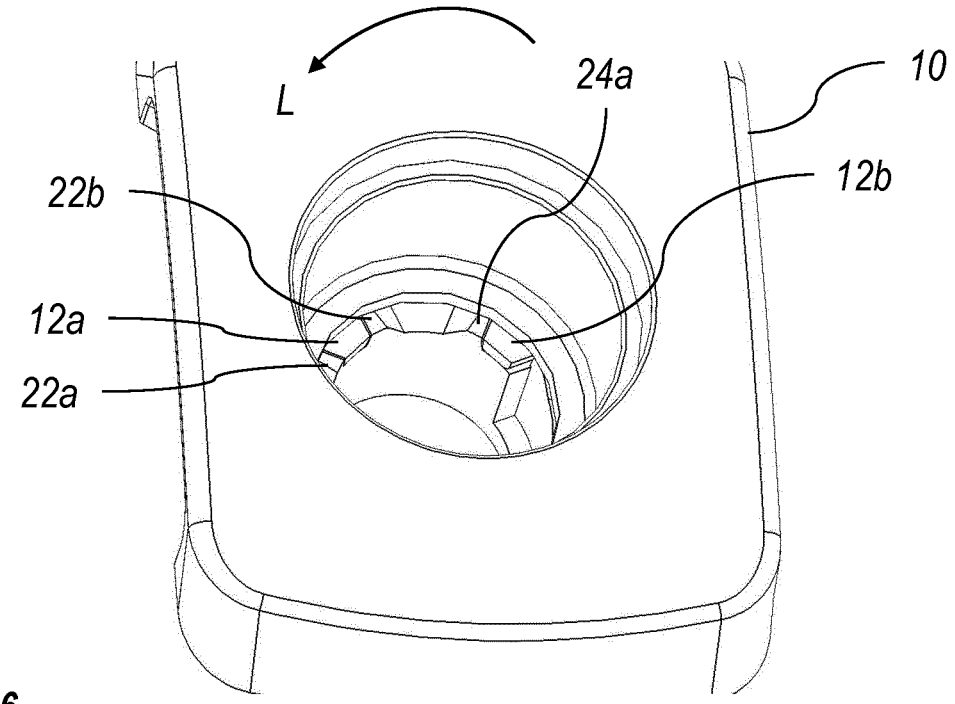
FIG. 6 shows a perspective view of a housing and guide ring according to an embodiment of the invention.

In FIG. 6 the guide ring 20 has been rotated in direction L. The protrusion 12*a* is thereby locked by left locking means 22. The protrusion 12*b* is further locked by left locking means 24. The guide ring 20 has reached a left locking position. When the guide ring 20 is rotated towards the left locking position, the inclined surfaces of the locking parts 22*a*, 24*a* guides the protrusions 12*a*, 12*b* towards the locking grooves 23, 25. When the protrusions 12*a*, 12*b* has reached the respective locking groove 23, 25, rotation of the guide ring 20 relative to the housing 10 is prevented. Hence, the guide ring 20 is locked in the left locking position.

Figure 7:
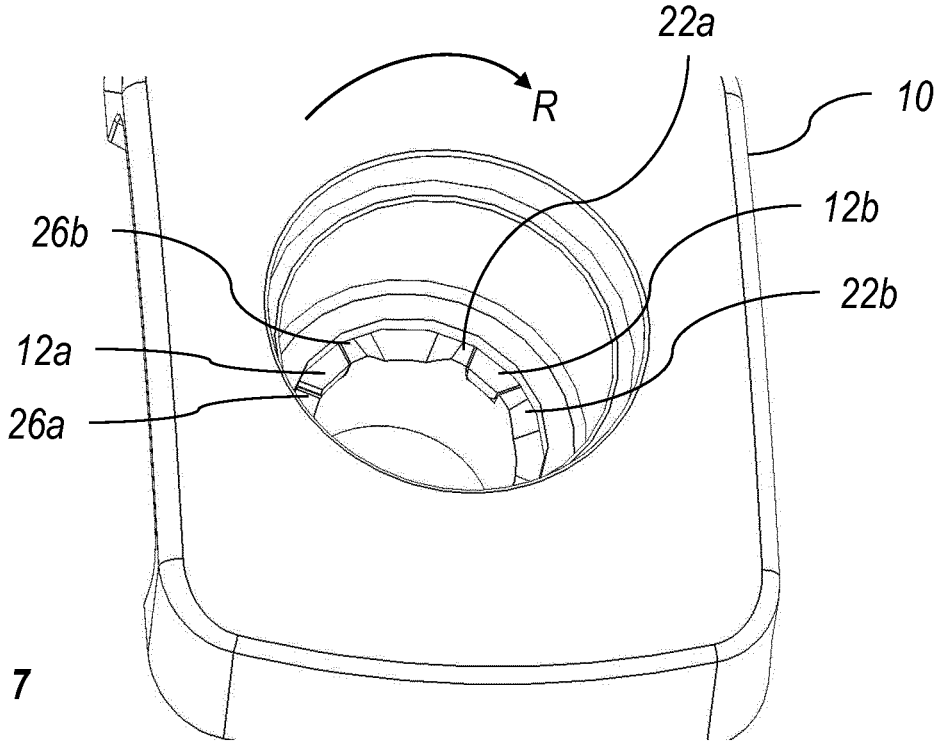
FIG. 7 shows a perspective view of a housing and guide ring according to an embodiment of the invention.

FIG. 7 correspondingly illustrates when the guide ring 20 has been rotated in direction R into a right locking position. The protrusion 12*a* is locked by the right locking means 26. The protrusion 12*b* is locked by the right locking means 22. When the guide ring 20 is rotated towards the right locking position, the inclined surfaces of the locking parts 26*b*, 22*b* guides the protrusions 12*a*, 12*b* towards the locking grooves 23, 27. When the protrusions 12*a*, 12*b* has reached the respective locking groove 23, 27, rotation of the guide ring 20 relative to the housing 10 is prevented. Hence, the guide ring 20 is locked in the right locking position.

Figure 8:
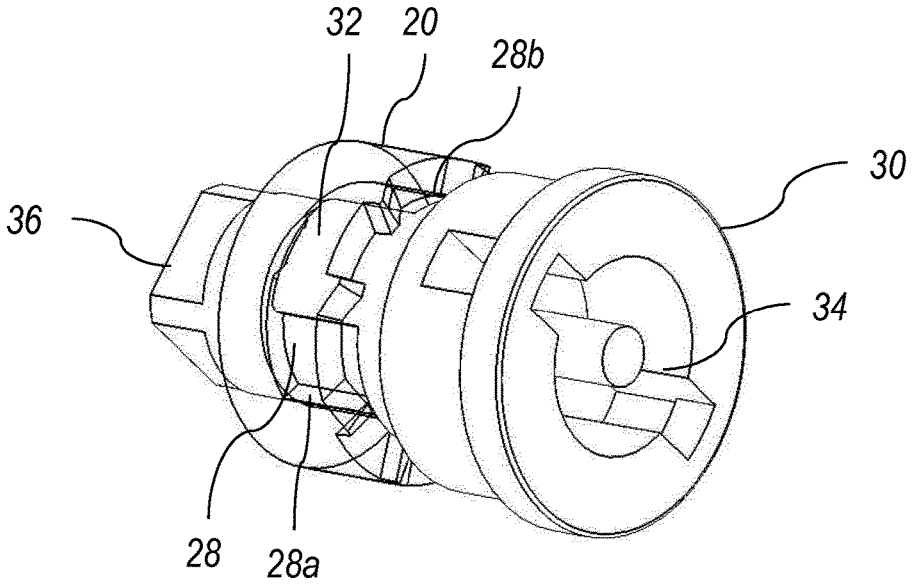
FIGS. 8-10 show perspective views of a guide ring and lock cylinder according to an embodiment of the invention.
Figure 9:
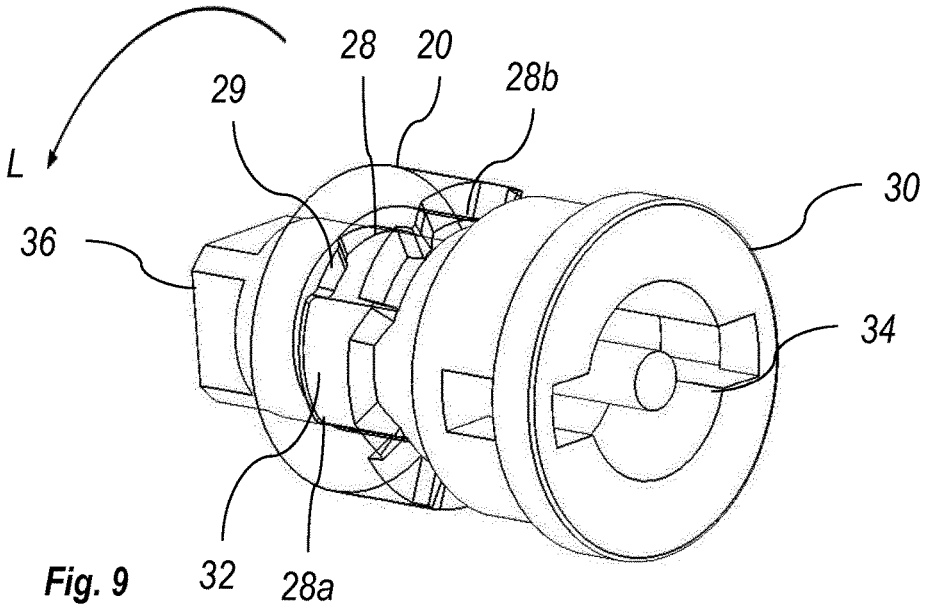
Figure 10:
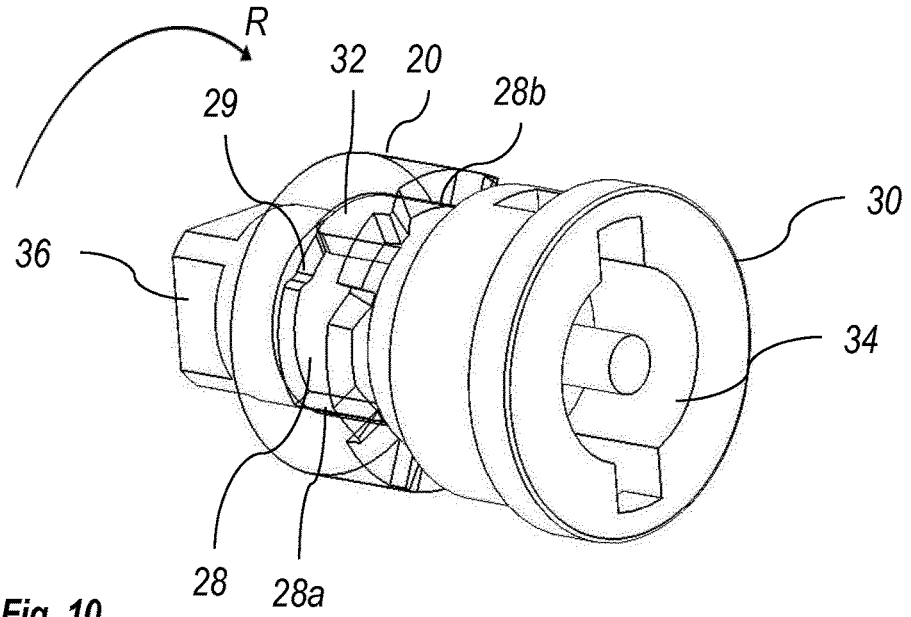

FIG. 8 illustrates the guide ring 20 in a transparent manner, and the lock cylinder 30 extending through the guide ring 20. The external protrusion 32 on the lock cylinder 30 is arranged in the peripheral recess 28 in the guide ring 20. The protrusion 32 and the recess 28 are configured such that the rotation of the lock cylinder 30 is limited by the peripheral extension of the recess 28. The recess 28 has a first end surface 28*a* and a second end surface 28*b*. The lock cylinder 30 can be rotated in a left direction L such that the protrusion 32 abuts the first end surface 28*a* of the recess 28 (see FIG. 9), and in a right direction R such that the protrusion abuts the second end surface 28*b* (see FIG. 10).

When the lock is arranged on a door such that the housing 10 is fixed relative to the door, and the guide ring 20 is in the intermediate position, and hence is rotatable relative to the housing 10, the lock cylinder 30 can be rotated in the left direction L such that the protrusion 32 reaches the first end surface 28*a* of the recess 28, and then be further rotated in the left direction L to rotate the guide ring 20 into the left locking position as described above.

Alternatively, when the lock is arranged on a door such that the housing 10 is fixed relative to the door, and the guide ring 20 is in the intermediate position, the lock cylinder 30 can be rotated in the right direction R such that the protrusion 32 reaches the second end surface 28*b* of the recess 28, and then be further rotated in the right direction R to rotate the guide ring 20 into the right locking position as described above.

The recess 28 comprises a shoulder 29 in a centre position between the end surfaces 28*a*, 28*b*. The shoulder prevents the protrusion 32 to move unintentionally from a position at the first end surface 28*a* to a position at the second end surface 28*b*, and vice verse.

Figure 11:
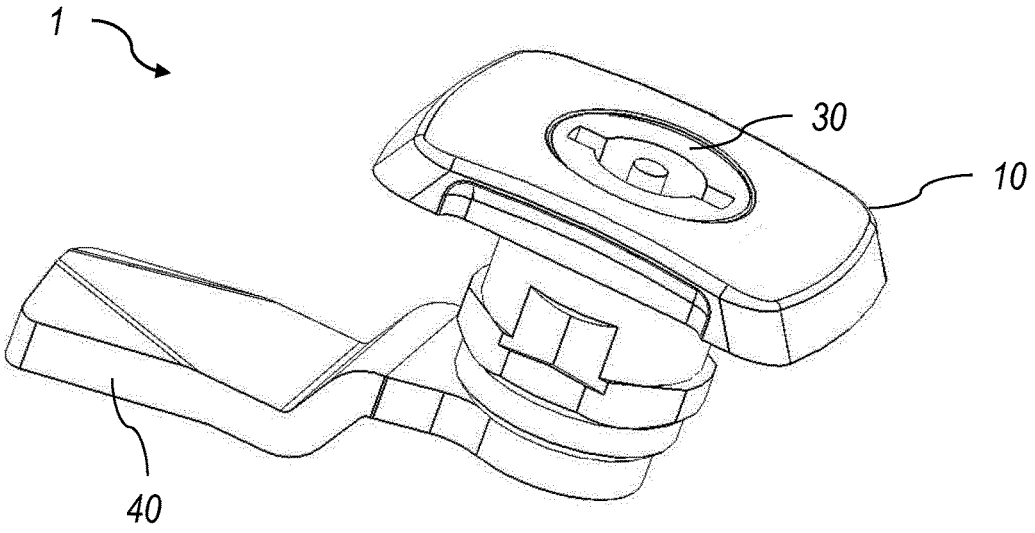
FIGS. 11-13 show perspective views of a lock according to an embodiment of the invention.
Figure 12:
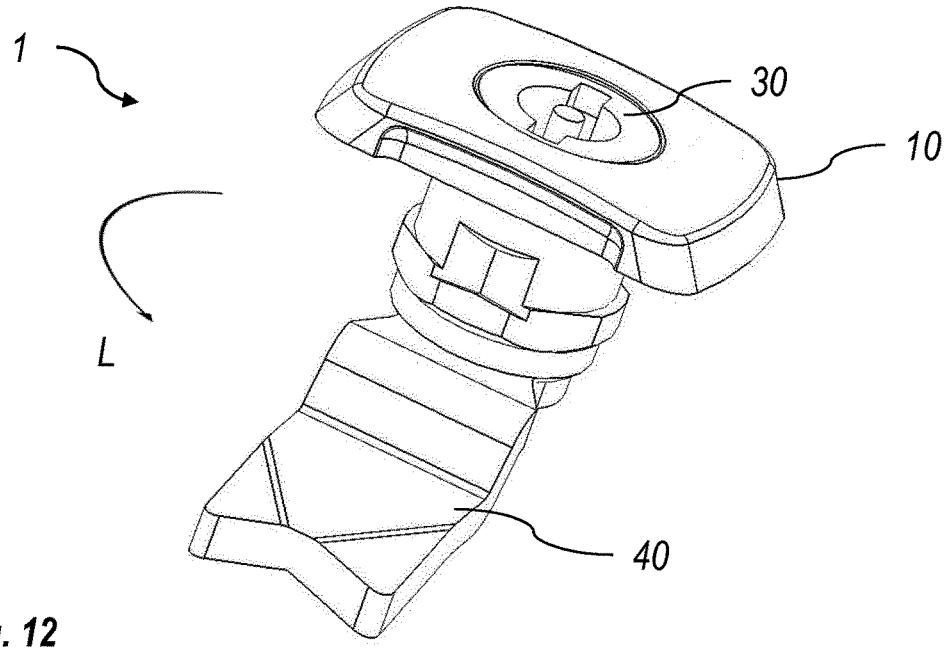
Figure 13:
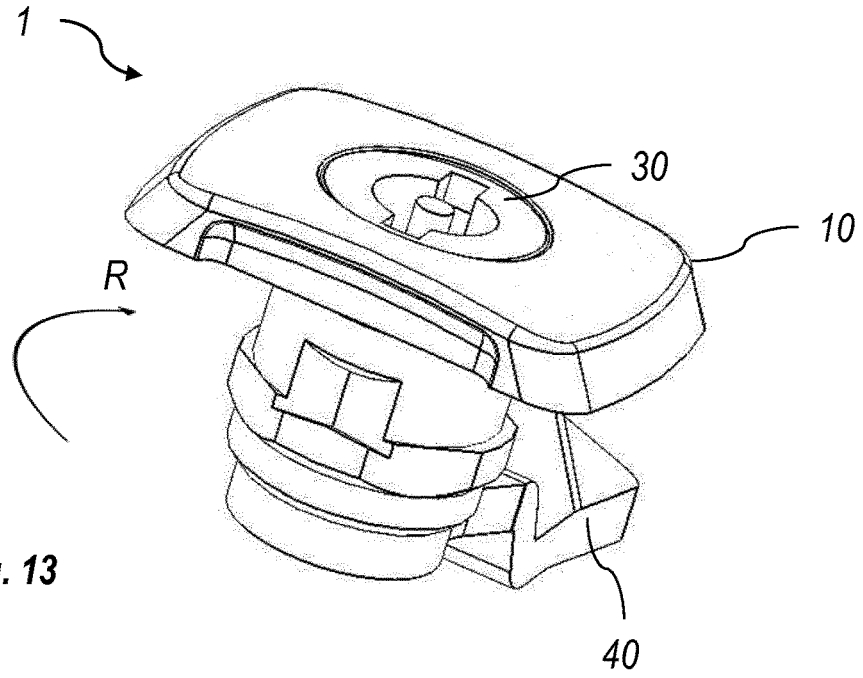

When the guide ring 20 has been locked in the left locking position, the recess 28 is located to enable a rotation of the lock cylinder 30, and the lock arm 40 attached to the lock cylinder 30, from an open position as illustrated in FIG. 11, in the left direction L to a locked position as illustrated in FIG. 12. In the locked position the lock arm 40 is configured to engage a door frame (not shown) such that a door (not shown) on which the lock 1 is arranged is locked relative to the door frame. Similarly, if the guide ring 20 has been locked in the right locking position, the recess 28 is located to enable rotation of the lock cylinder 30 from the open position in FIG. 11, in the right direction R to a locked position as illustrated in FIG. 13.

Hence, depending on which locking position the guide ring 20 is locked in relative to the housing 10, the operation of the lock cylinder 30 and the lock arm 40 for the door on which the lock 1 is arranged is to the left or to the right. The same lock, assembled in the intermediate configuration of the guide ring 20, may thereby be used for either left or right configuration depending on how the guide ring 20 is rotated and locked after the lock has been arranged on the door.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A lock (1) for a door comprising a housing (10) having a circular opening (11) in which a radial protrusion (12*a*, 12*b*) is arranged, and a guide ring (20) arranged in said opening, wherein the guide ring comprises a left locking means (22, 24) and a right locking means (22, 26), wherein the radial protrusion in a first position of the guide ring is located between the left locking means and the right locking means on the guide ring, wherein the guide ring is configured to be rotatable from the first position in a first direction (L) into a left locking position such that the protrusion engages with the left locking means so as to lock the guide ring relative to the housing, and wherein the guide ring is configured to be rotatable from the first position in a second direction (R), opposite the first direction, into a right locking position such that the protrusion engages with the right locking means so as to lock the guide ring relative to the housing.

2. The lock according to claim 1, wherein the left and right locking means (22, 24, 26) are arranged on an axial rim (21) of the guide ring (20).

3. The lock according to claim 1, wherein each of the left and right locking means (22, 24, 26) comprises an inclined member engageable with the radial protrusion (12*a*, 12*b*).

4. The lock according to claim 3, wherein each inclined member comprises two inclined parts (22*a*, 22*b*, 24*a*, 24*b*, 26*a*, 26*b*) forming a locking groove (23, 25, 27) in between.

5. The lock according to claim 1, wherein the lock, when the guide ring (20) is in the left locking position, is left-hand operated when arranged on a door, and wherein the lock, when the guide ring is in the right locking position, is right-hand operated when arranged on a door.

6. The lock according to claim 1, wherein the lock further comprises a lock cylinder (30) arranged in the opening (11) and configured to rotate the guide ring (20).

7. The lock according to claim 1, wherein the guide ring (20) comprises an inner peripheral recess (28).

8. The lock according to claim 7, wherein the peripheral recess (28) extends along at least 80 degrees of an inner circumference of the guide ring (20), preferably between 90-150 degrees, more preferably between 110-140 degrees.

9. The lock according to claim 6, wherein the lock cylinder (30) comprises an external protrusion (32) on an outer surface of the lock cylinder, which external protrusion is configured to be arranged in the peripheral recess (28) of the guide ring (20).

10. The lock according to claim 9, wherein the lock cylinder (30) is rotatable relative to the housing (10) in an extent limited by the peripheral recess (28) of the guide ring.

11. The lock according to claim 6, wherein when the lock is arranged on a door, the guide ring in the left locking position provides a position of the peripheral recess (28) corresponding to the lock cylinder (30) being rotatable for a left-hand operation of the lock, and in the right locking position provides a position of the peripheral recess corresponding to the lock cylinder being rotatable for a right-hand operation of the door.

12. The lock according to claim 11, wherein the lock cylinder (30), when the guide ring is in the left or right locking position, is rotatable about 90 degrees.

13. The lock according to claim 1, wherein the radial protrusion comprises a first radial protrusion (12*a*) and a second radial protrusion (12*b*).

14. The lock according to claim 13, wherein the guide ring (20) comprises a first locking means (26), a second locking means (22) and a third locking means (24), wherein when the guide ring is in the first position, the first radial protrusion (12*a*) is located between the first locking means (26) and the second locking means (22) and the second radial protrusion (12*b*) is located between the second locking means (22) and the third locking means (24), such that for the first radial protrusion (12*a*), the second locking means (22) is a left locking means and the first locking means (26) is a right locking means, and for the second radial protrusion (12*b*) the third locking means (24) is a left locking means and the second locking means (22) is a right locking means.

* * * * *